United States Patent [19]

D'Agnolo et al.

[11] 3,941,323

[45] Mar. 2, 1976

[54] DEVICE FOR FINDING, EXTRACTING AND TEMPORARILY POSITIONING THE END OF THE YARN IN COPS

[75] Inventors: Armando D'Agnolo; Giovanni Favero, both of Pordenone, Italy

[73] Assignee: Officine Savio, S.p.A., Pordenone, Italy

[22] Filed: Apr. 30, 1974

[21] Appl. No.: 465,690

[30] Foreign Application Priority Data

May 4, 1973 Italy ..... 83363/73

[52] U.S. Cl. ..... 242/18 R; 242/35.6 E

[51] Int. Cl.[2] ..... B65H 54/22

[58] Field of Search ..... 242/18 R, 35.6 E, 35.6 R, 242/35.5 R, 35.5 A

[56] References Cited

UNITED STATES PATENTS

| | | | |
|---|---|---|---|
| 2,675,971 | 4/1954 | Abbott | 242/35.6 R |
| 3,224,694 | 12/1965 | Oishi | 242/35.5 R |
| 3,381,908 | 5/1968 | Igushi et al. | 242/35.6 E |
| 3,471,101 | 10/1969 | Moyer et al. | 242/35.6 R |
| 3,480,216 | 11/1969 | Iannucci et al. | 242/35.6 R |

*Primary Examiner*—Stanley N. Gilreath
*Attorney, Agent, or Firm*—Stevens, Davis, Miller & Mosher

[57] ABSTRACT

A device for finding, extracting and temporarily positioning the end of the yarn in cops. More particularly, a device that uses single-cop compartments, which move forward in steps, and wherein the cops lie projecting from both ends of the compartments and already correctly oriented. The part on the end of the bobbin is affected by three actions to extract the end of the yarn, two of them being mechanical and the other being pneumatic. Subsequently all the wound yarn is affected by a sucking action so as to pick up the end of the yarn with certainty, wherever it may be. The operations are carried out in four successive stations, wherein the cops are kept in rotation between suitable mandreltailstock groups except in the third station, where the cops are halted.

13 Claims, 9 Drawing Figures

DEVICE FOR FINDING, EXTRACTING AND TEMPORARILY POSITIONING THE END OF THE YARN IN COPS

The present invention relates to a device for finding and extracting the end of the yarn in cops and also for temporarily positioning the end when extracted.

To be more specific, the present invention relates to a device suitable for eliminating the tail end lying on one end of the bobbin, for finding and extracting the end thereof, for positioning it temporarily and keeping it so positioned while the cop is moved to the point of its delivery to a usage means positioned downstream from the device. Systems are known which eliminate the end of the yarn and recover the tail end. Some of these systems arrange for the cop to be still during the operation while others keep it in a rotating/forward movement. Still other systems arrange for the action of mechanical elements acting together with jets of air. Others only arrange for jets of air. Yet still others only arrange for a sucking action.

The primary object of the present invention is to offer a high degree of reliability as regards finding the end of the yarn and eliminating the tail end. This object is all the more important inasmuch as with the present automatic machines and with the speed of supply demanded (up to one cop every one to two seconds) maximum reliability is necessary as regards the pre-arrangement of cops with the end of the yarn found for delivery to the kind of usage means contemplated.

A consequential object, therefore, is to obtain cops, with the end of the yarn found and pre-arranged, at the required speed.

A further object is to eliminate the end of the yarn positioned below the wound yarn in cops spooled onto conical bobbins.

Yet another object is to find the end of the yarn without ruining the wound yarn and also to eliminate the tail end even when the tail end is astride the wound yarn or when the bobbins have a metal protecting collar.

Furthermore the present invention tends to find the end of the yarn in any temporary position it may occupy along the cop in cases where is has been previously separated from the tail end on one end of the bobbin.

A further object is to arrange a supplementary station for guaranteeing the achievement of all of the foregoing objects of the invention. The present invention offers many useful features. The first useful feature lies in the high degree of efficiency in locating the end of the yarn.

A second useful feature lies in the exact and temporary positioning of the end of the yarn of the cops being delivered to the device which transfers them to the usage means.

A further useful feature lies in the speed with which the prearranged cops are delivered, i.e., up to one cop every one to two seconds.

Furthermore, the cops which undergo the action of the device do not suffer breakage in the surface layers of the wound yarn since the cop and its relative container are only separated from each other at the time of the delivery of the cop, with the end of the yarn found, to the usage means.

Another useful feature lies in the ability to proceed with the pre-arrangement of cops with a conical bobbin and, more particularly, with the pre-arrangement of cops with the tail ends positioned on one end of the bobbin without the need to ascertain the exact position of the tail ends in respect of the wound yarn.

A further useful feature lies in the simultaneous transferral of a cop and the end of the yarn found in a synchronized manner to the point of delivery of the cop to the usage means.

These objects and useful features together with other objects and useful features, are realized by a device which finds, extracts and temporarily positions the end of the yarn in cops, the cops lying properly oriented in the compartments of a conveyor which moves forward in steps. The compartments are substantially horizontal and the ends of the cops project from the two ends of the compartments. The device is characterized by the fact that it presents in reciprocal cooperation and combination:

- a first station with an opposed rotating mandrel and tailstock, of which at least one is movable axially, and with extraction grippers which move axially and transversely,
- a second station with an opposed rotating mandrel and tailstock, of which at least one is movable axially, and with a vibrating eliminating spatula,
- a suction opening, placed below said stations and cooperating with
- a third station with a means for halting the cop, a suction opening, shears and a means for detaining the end of the yarn,
- a fourth station with an opposed rotating mandrel and tailstock, of which at least one is movable axially,
- and with an axially slotted suction conveyor, which cooperates with
- some shears and with
- a means for positioning the found end of the yarn, and
- a fork for lifting cops which works in association with both the mandrels and tailstocks of the first, second and fourth stations and operates by the side of the ends of the movable compartments.

The present invention will be made clearer by the following description and the accompanying drawings wherein a nonlimitative preferred layout is given and in which.

In the figures the same reference numbers indicate the same parts or parts having the same purposes or functions.

Figure 1:
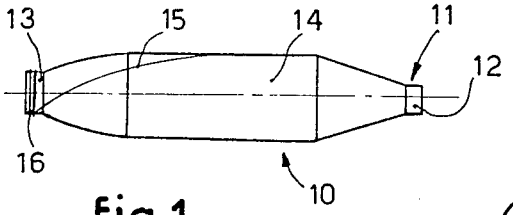
FIG. 1 shows a cop with a conical bobbin and with the tail end twisted round below the wound yarn.

With reference to FIG. 1, cop 10 is formed of a bobbin 11 with its two ends 12 and 13 and wound yarn 14 with the end of the yarn 15 and with the excess coils 16 twisted around the end 13 below the wound yarn.

Figure 2:
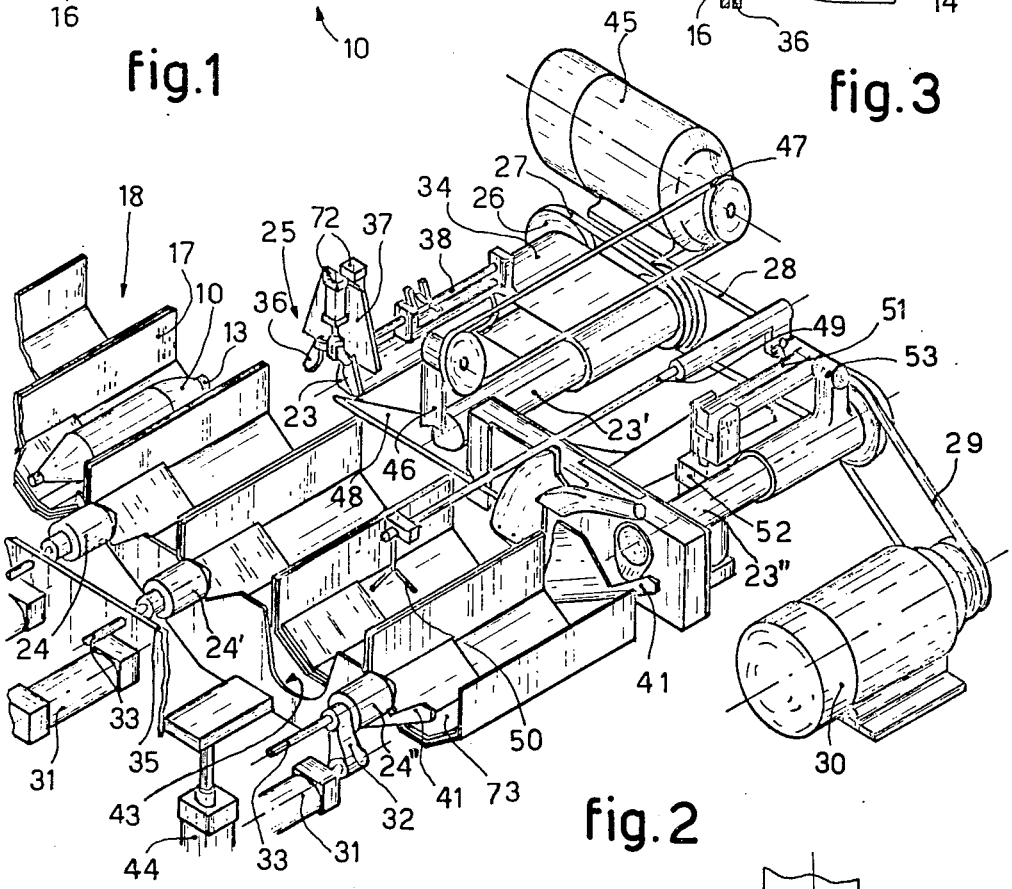
FIG. 2 shows a partial perspective view of the device of the present invention.

In FIG. 2 cops 10 move forward within horizontal or almost horizontal compartments 17 of the conveyor 18. The conveyor is activated by any type of kinematic movement able to make it move forward in steps. The cops 10 move forward with the end 13 of bobbin 11 oriented as in FIG. 2.

Figure 7:
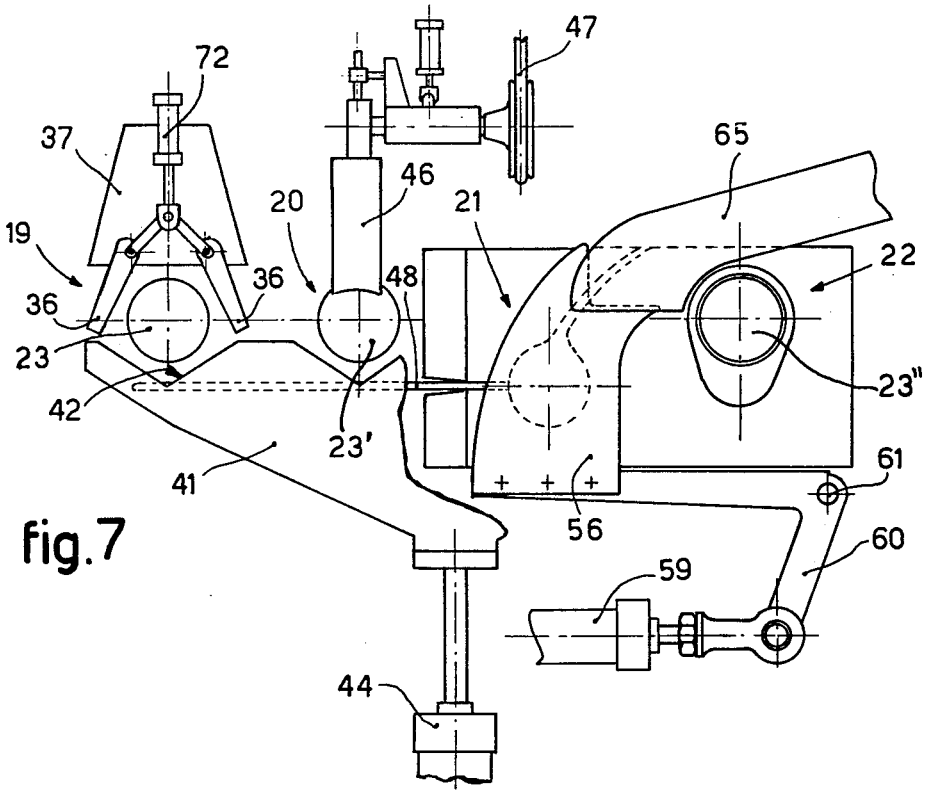
FIG. 7 shows a side elevational view of the driving mandrels with the specific devices.

The device is composed of four stations, of which the first is 19, the second 20, the third 21 and the fourth 22 (see FIG. 7 for greater clarity). The four stations attend to different purposes, one completing the action of another. The first station 19 serves both to loosen the tail end 16 below the wound yarn and to move it away from the wound yarn 14 towards the edge 13 of the bobbin.

This station is important both in the case where the tail end 16 is positioned too close to the wound yarn 14 and in the case where the tail end 16 has been wound too tight and also in the case where the bobbin is damaged or has a metal protection collar.

In station 19 there is a rotating mandrel 23 and, on the same axis therewith and on the other side of the compartment 17, a free-turning tailstock 24 (a freely rotating roller), which is axially displaceable towards 23. Lastly, there are grippers 25, which act in coordination with the rotating mandrel 23. The rotating mandrel 23 and the free-turning tailstock 24 is the same in the first, second and fourth stations.

The rotating mandrel 23 is activated by the pulley 26, which receives its motion from the motor organ 20 through the play of the belts 27-28-29. The free-turning tailstock 24 moves axially owing to the effect of the piston 31, which by means of the support 32 is able to move the free-turning tailstock 24 backwards and forwards, the tailstock being guided by the pin 33. The rotating mandrel 23 is sustained by the support 34, while the pistons 31 are sustained by the plate 35, which also has the respective guide holes for the pins 33. In coordination with the rotating mandrel, the grippers 25 are axially moved backwards and forwards, while the feeler means 36 are activated transversely by the small piston 72. The feeler means 36 are made of an elastic material and are four in number, two being on one side and two on the other side of the axis of the cop.

Figure 3:
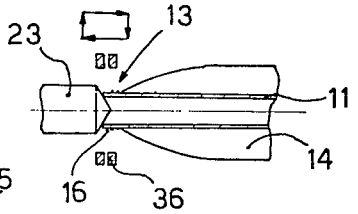
FIGS. 3 and 4 show diagrammatically the working principles of the first and second stations.

The feeler means 36 close up towards said axis when the grippers 25, which have by now moved forwards as far as possible, begin to move backwards. The feeler means 36 reopen when the grippers 25 have reached their most rearward position and start to move forwards (see FIG. 3).

During the phase of backwards movement of the grippers 25, the feeler means 36 are thus closed and press against the part 13 of the bobbin 11, which is rotating between the mandrel 23 and the tailstock 24. This causes the tail end 16 to tend to slacken off (the rotation being in the opposite direction to the winding of the tail end) and to be extracted.

Figure 4:
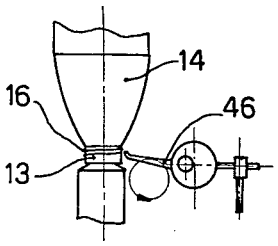
Figure 6:
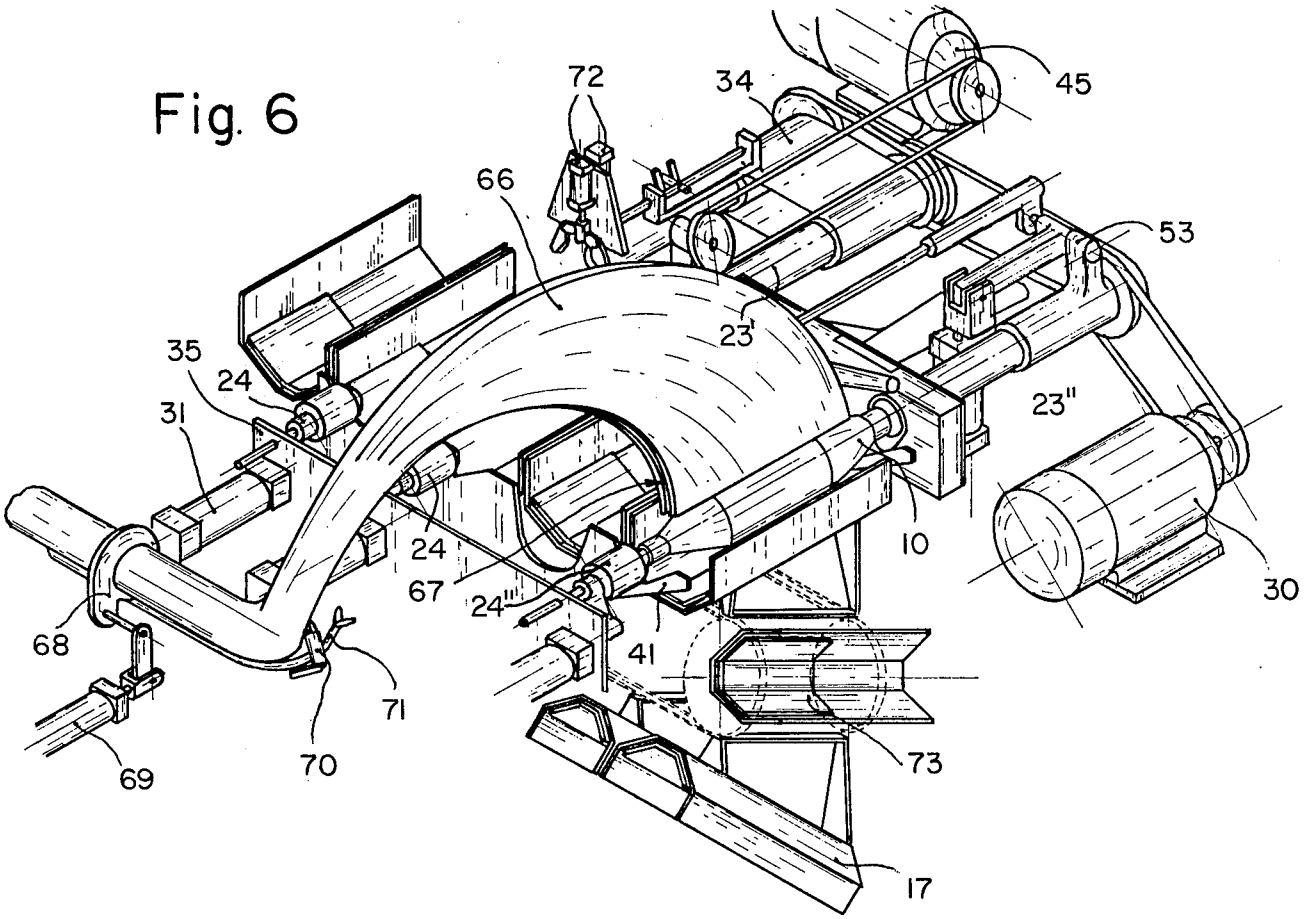
FIG. 6 shows a perspective view of the device of the present invention complete with the suction conveyor.
Figure 8:
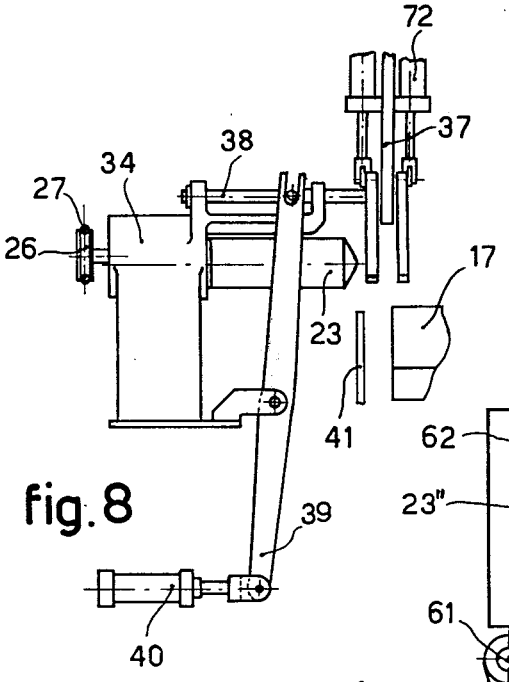
FIG. 8 shows an elevational view of the first station.

The feeler means 36 may be of different lengths (see FIGS. 6 and 8), and this would cause them to act at different points. The grippers 25 are sustained by the support 37, which in turn is sustained and guided by the small shaft 38. The small shaft 38 is moved forwards and backwards by the lever 39, which is activated by a motor means 40. The small shaft 38 is not fixed firmly in a lateral direction but can carry out a small pivoting movement, which allows the feeler means 36 to adapt themselves better to the area on which they have to act. The cop 10 advances in steps, moving from station to station. So as to be positioned between the mandrel and the tailstock, it is lifted from the compartment 17 by the lifting means 41, which is at both sides of the compartments 17, until it is on the same axis as the mandrel and the tailstock. The lifting means 41 acts on the ends 12 and 13 of the cops through the "V"s 42 which are present therein and which coincide with the stations 19-20-22, there coinciding with the station 21 a cutaway stretch 43 because, according to the invention, the cop has to remain in the compartment here. The lifting means 41 is activated by the piston 44 in coordination with the beginning of each cycle, a cycle coinciding with the arrival of compartment 17 in successive stations or with the forward movement of the compartment 17 to a station. When the lifting means 41 has reached top dead center, the tailstock 24 moves toward mandrel 23 and thus holds the cop 10 between 23 and 24, the cop being at once set in rotation by the rotating mandrel 23. The second station 20 also has a mandrel 23′ and a tailstock 24′. In addition the station 20 has a spatula 46, which is activated by the motor means 45 through a belt 47. In FIG. 7 can be seen how the belt 47 activates the pulley, whose axle bears at its end an eccentric pivot. This eccentric pivot rotates and causes the spatula to rotate. Again in FIG. 7 can be seen the piston, which is placed above and serves to lower the spatula 46 at the beginning of the phase and to raise it at the end of the phase. The spatula 46 moves continuously but is only lowered during the phase itself so as to be able to act on any tail end. The spatula 46 (see FIG. 4) moves with an almost circular movement, one part of its rotary movement bringing it into contact with the bobbin. The generative principle of the spatula 46 is known.

Figure 5:
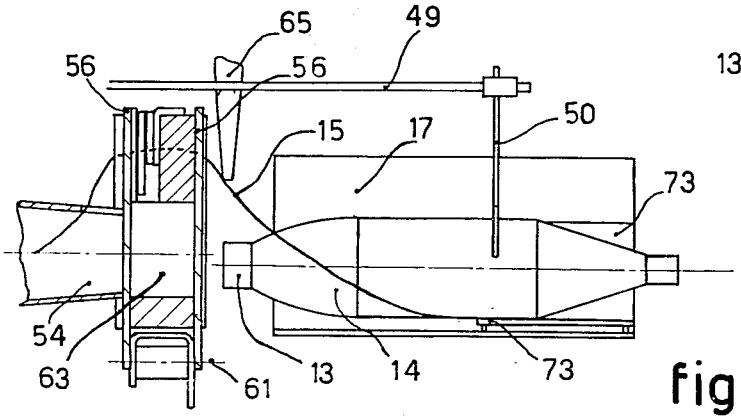
FIG. 5 shows a transverse section of the third station.
Figure 9:
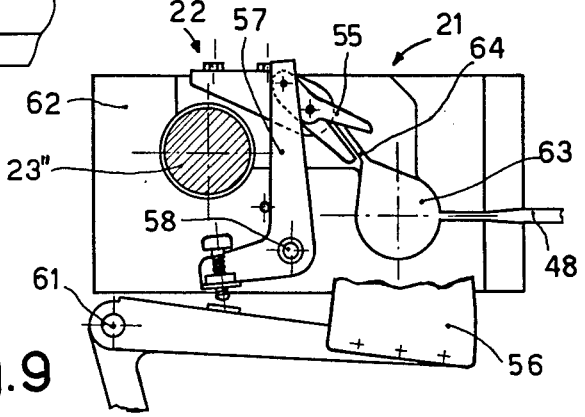
FIG. 9 shows an elevational view of the third station from the rear.

While the cop 10 is rotating, the elastic end part of the spatula 46 slides against the projection 13 of the bobbin below the wound yarn and carries out a violent action against any portion of the tail end not extracted by the grippers 25. The spatula 46 rotates continuously and is only lowered when a cop 10 has been placed between the mandrel 23′ and the tailstock 24′ of the second station 20. The spatula 46 is then raised at the end of the cycle. Below both the first two stations 19 and 20 there runs a suction opening 48, which serves to collect any tail end extracted by the grippers 25 or the spatula 46, together with all threads and/ or remains detached from the cop 10 in the stations 19 and 20. The combination of the unwinding-extracting action of the grippers 25 with the violent action of the spatula has been planned to guarantee maximum efficacy even when the bobbins 11 are not new, namely even when it is necessary to work with bobbins 11 having a damaged or dented edge, which, added to the negative conicity of the area 13 of the bobbin positioned below the wound yarn 14, makes very questionable the ability to loosen and extract the tail end 16. After the cop 10 has undergone the action of the first two stations 19 and 20, it passes on to the third station 21. In this station the cop is not lifted but remains in the compartment 17. Cop 10 also is kept still in the compartment 17 by the arm 49, which bears at its free end the fork 50. Arm 49 is hinged at 53 and moves on a vertical plane by means of the extension 51. Cylinder 52 acts on the extension 51 to make arm 49 move. Station 21 is equipped only on the side where the tail end 16 below the wound yarn 14 passes by. The equipment of station 21 consists of a suction opening 54 and shears 55 positioned between opening 54 and the end 13 of the cop 10. Shears 55 are activated by a double fork 56. The shears 55 (see FIGS. 5 and 9) are activated by a lever 57, hinged at 58, which is governed by the movement of the double fork 56 during the last stretch of the ascent of said double fork. The double fork 56 is activated by a motor organ 59, which controls the functioning of the double fork 56 through the lever 60 hinged at 61. In the block 62, which is in an intermediate position between the cop 10 and the suction opening 54, where the shears 55 are seated, there is in continuation of the suction opening 54 a channel 63, to which there arrives the auxiliary opening 48 and from which there departs a slot 64. In front, towards the cop 10, there is the suction opening 65. When a new compartment 17 arrives in the station 21, the fork 50 descends and clamps the cop 10 in the compartment 17. If the internal support 73 is present in the compartment 17, it straightens the cop. The inner support 73 (see FIGS. 2, 5 and 6) is, as shown in FIG. 5, a support which partly covers the container 17. This support 73 owing to the effect of the fork 50 which presses the cop from above, permits the cop itself to remain separated from the bottom and thus to leave the end of the yarn free to unwind over a great length thereof. The clamping is necessary to prevent the cop 10 from being sucked away by the suction opening 54. When the cop 10 has been clamped in the compartment 17, the double fork 56 descends and frees the suction passages 54–63. When the cop arrives in front of the opening 63, which is prolonged by the suction conduit 54, the end of the yarn 15 is sucked inside. Then the forks 56 (one in front of and the other behind the opening 63) raise the end of the yarn and insert it into the slit 64. When the arm (FIG. 9) which bears the forks 56 has almost reached top dead center, it activates the lever 57, which makes the shears 55 work, and these latter cut the end of the yarn 15 in such a way that the part already inside the passage 54 is drawn away. The forks 56 are sustained by the arm 60 (FIG. 7) and activated by the piston 59. The opening of the passage 54–63 has two effects. The first effect follows from the fact that any threads waiting in the suction opening 48 and close to the front fork 56 are sucked away. The second effect follows from the fact that the end part 13 of the cop 10 and the lower part of the wound yarn 14 undergo a violent action of suction, which is concentrated along the compartment 17 and thus invests the whole outer part of the cop 10. The presence of the internal support 73 in the compartment 17 makes possible a better action of suction around the cop and, meanwhile, does not allow the end of the yarn 15 to unwind more than a certain amount. This sucking action accentuates the effect of the two previous stations and is capable of extracting any excess coils below the wound yarn which may have escaped the action of the two previous stations.

The sucking action also serves to find any free ends of yarn 15. When an end of the yarn 15 enters the passage 54–63, it is raised by the respective "V"s of the two forks 56, which guide it along the slot 64. At the end of their course of ascent the two forks 56 activate the shears 55, which cut off the end of the yarn 15. The part cut off is sucked away and discharged. The remaining part is then sucked in by the auxiliary positioning opening 65. The yarn remains in the positioning opening 65 for the time required for the cop to pass on to the next station. The auxiliary positioning opening 65 has a minimal suction effect. When the cop 10 reaches the fourth station 22, it is raised by the lifting means 41 and placed between the rotating mandrel 23'' and the axially movable tailstock 24'' and is supported by them and set in rotation. Above the cop 10, placed between the mandrel 23'' and the tailstock 24'' (see FIG. 6), there is an axial suction opening 66, which operates peripherally along the axis of the cop 10. The opening 66 has a slit 67 and an air-lock shutter 68, which is activated by a motor means 69. The shutter 68 opens simultaneously with the fixture of the cop 10 between the mandrel 23'' and the tailstock 24'' and closes at the end of the cycle. The effect of the opening 66 on the cop 10 is such that, as the suction effect of 66 is greater than that of 65, the end of the yarn 15 present in the auxiliary opening 65 is drawn away by the axial opening 66. This withdrawal also is simplified by the direction of rotation imparted to the cop 10 by the mandrel 23'' and the tailstock 24'', said direction of rotation tending to unwind the end of the yarn 15 from the wound yarn 14. Owing to the effect of the sucking action of the opening 66, the end of the yarn is sucked in and lies in the conduit of the opening 66 so long as the shutter 68 is open and the cop 10 is between the mandrel 23'' and the tailstock 24''. When the cop 10 again drops into the compartment 17, the end of the yarn 15 comes out of the slit 67 and is positioned as in FIG. 6.

At the base of the axial opening 66 there are some automatic continuous shears 70 and, when the yarn comes between their blades, they cut it so that the severed end is discharged, while the remainder, which has been kept tight up to that moment, is held by the auxiliary retaining suction opening 71. When the end of the yarn is sucked in by opening 66 and has just been pulled tight, it comes out of the slit 67 like a cord. In this position it passes between the "V" of the suction opening 71; and when the shears 70 cut the end of the yarn the part which is already in the conduit is sucked away while the part that is towards the cop is held by the suction opening 71. At this point the cop 10 is ready and can be transferred to a usage means of a known form which, in any case, does not concern the essence of the present invention. In accordance with the invention, a cop 10 thus undergoes the action of four stations (19 to 22) which cooperate, each one of them having its own purpose and being complementary to the preceding one.

With this type of device one can have a cop 10 ready every one to two seconds, this being the cycle of treatment which a cop 10 undergoes in each single station.

A preferred layout has been shown which, as said previously, is not limitative since it is possible to bring in numerous variants as every technician in this field can well understand.

Thus it is possible to arrange for the feeler means 36 to have a different shape and lengths. It is also possible to unify their drive or to apply a separate drive to each single feeler means 36. It is also possible to replace the driving system 40 with a cam or else to eliminate 39 and 40 and place the drive in axis with the small shaft 38. Furthermore each single rotating mandrel 23 could be activated by its own motor of an electric or air type. Again, the spatula 46 can be replaced with a multiple rotating spatula. It also is possible to replace the opening 71 with a ring or other mechanical positioning means. It is further possible to arrange in the compartments 17 the internal support 73 with or without an additional support to straighten up the cop 10.

These and other possible variants either in the constructive form or in the layout indicated are, therefore, possible without thereby departing from the scope and intent of the inventive idea.

What is claimed is:

1. A device for finding, extracting and temporarily positioning the end of the yarn in cops, wherein the cops are correctly oriented in the compartments of a conveyor which moves forward in steps, the compartments being substantially horizontal, and wherein the ends of the cops project from the two ends of the compartments, comprising a first station with opposed rotating mandrel and tailstock, said tailstock being axially movable, and with extraction grippers which move axially and transversely; a second station with opposed rotating mandrel and tailstock, said tailstock being axially movable, and with a vibrating eliminating spatula; a suction means positioned below said stations; a third station cooperating with said opening having a means for clamping a cop, a suction opening, shears and a means for retaining the end of the yarn; a fourth station with opposed rotating mandrel and tailstock, said tailstock being axially movable, and having a suction conveyor means, which has an axial slit; a means cooperating with said slit for positioning the end of the yarn, when found; and a plate means for lifting cops, which operates in cooperation with mandrels and tailstocks of the first, second and fourth stations and functions in a line outside the ends of movable compartments.

2. The device of claim 1, in which the opposed rotating mandrels and tailstocks consist of a fixed rotating mandrel and a free-turning tailstock, each mandrel and tailstock group being positioned on the same axis and at the two ends of the compartments and including a motor means for activating the rotating mandrels positioned on one side of the ends of the compartments and working in cooperation with the end of the bobbin below the wound yarn of a cop.

3. The device of claim 1, in which said plate means for lifting cops are disposed outside the two ends of the compartments, said plate means having V-shaped notches therein which cooperate with the ends of the bobbin that project out from the wound yarn of a cop, said notches at the intersection of the V being positioned on an axis with the axes of the mandrels and tailstocks of the first, second and fourth stations, and has a cut-away section in line with the third station.

4. The device of claim 1, including an axially movable shaft and a support on said shaft, said extraction grippers in the first station being anchored in an oscillating manner on said support and placed on the side of the device with the rotating mandrel.

5. The device of claim 4, including feeler means made of an elastic material and cooperating with that end of the bobbin which projects out below the wound yarn on a cop that is rotating between the mandrel and the tailstock of station 1, said feeler means including a piston-type motor means which activates the feeler means perpendicularly to the axis of the cop to press against the end of the bobbin during axial movement towards the rotating mandrel and to not contact the end of the bobbin during axial movement away from the rotating mandrel.

6. The device of claim 1, including an eccentric pivot to which is attached the vibrating eliminating spatula of the second station and means to raise and lower said eccentric pivot, said spatula being made of a flexible material and placed on the same side as the rotating mandrel, said spatula cooperating against the end of the bobbin of a cop which is rotating between the mandrel and tailstock.

7. The device of claim 1 including at the third station a double fork for lifting the end of the yarn and a transfer conduit working in cooperation with said double fork, said means for clamping a cop being vertically movable, said shears being located at the end of said transfer conduit, said suction means positioned below said first and second stations communicating with said suction opening.

8. The device of claim 1, including an internal support within the compartment cooperating with said means for clamping a cop.

9. The device of claim 1, in which the means for clamping a copy are vertically movable and includes a fork means for clamping a cop in the bottom of a compartment, a controlling shaft means attached thereto which pivots in the vertical plane of the fork means and a piston-type motor means for driving said means for clamping a cop.

10. The device of claim 1, in which at the third station the suction opening, lying axially of the axis of a cop placed in the compartment, has at its front a supplementary conduit with at least one yarn lifting means and a transfer conduit at which end thereof said shears are positioned, said yarn lifting means having a "V" notch for guiding the end of the yarn, when found, along the transfer comduit.

11. The device of claim 7, in which the shears are activated by the yarn lifting means.

12. The device of claim 1, in which the suction conveyor means is positioned axially of the bobbin, in its lower side its axial slit is for holding the end of the yarn under tension and has in a rearward position a closure shutter.

13. The device of claim 12, in which the means for positioning the end of the yarn, when found lies in a position below the axial suction conveyor, and includes shears at the side of and downstream from the positioning means, the shears being placed between said positioning means and the end of the slit towards said closure shutter, the slit, shears and positioning means being on the same axis and the positioning means being a suction opening.

* * * * *